US010512854B2

(12) United States Patent
Arnold

(10) Patent No.: US 10,512,854 B2
(45) Date of Patent: Dec. 24, 2019

(54) MAGNUS EFFECT CYLINDRICAL PROJECTILE AND LAUNCHER

(71) Applicant: L. Taylor Arnold, Durham, NC (US)

(72) Inventor: L. Taylor Arnold, Durham, NC (US)

( * ) Notice: Subject to any disclaimer, the term of this patent is extended or adjusted under 35 U.S.C. 154(b) by 0 days.

(21) Appl. No.: 16/101,905

(22) Filed: Aug. 13, 2018

(65) Prior Publication Data

US 2018/0345163 A1 Dec. 6, 2018

Related U.S. Application Data

(63) Continuation-in-part of application No. 15/595,457, filed on May 15, 2017, now Pat. No. 10,046,248.

(51) Int. Cl.

| | |
|---|---|
| ***F41B 7/00*** | (2006.01) |
| ***A63H 33/18*** | (2006.01) |
| ***F41B 7/08*** | (2006.01) |
| ***A63H 31/08*** | (2006.01) |
| ***F41B 4/00*** | (2006.01) |
| ***F41B 7/02*** | (2006.01) |

(52) U.S. Cl.

CPC ..... *A63H 33/185* (2013.01); *A63H 31/08* (2013.01); *F41B 4/00* (2013.01); *F41B 7/003* (2013.01); *F41B 7/02* (2013.01); *F41B 7/08* (2013.01)

(58) Field of Classification Search

CPC ..... F41B 7/00; F41B 7/08

See application file for complete search history.

(56) References Cited

U.S. PATENT DOCUMENTS

| | | | | |
|---|---|---|---|---|
| 3,018,584 A * | 1/1962 | Passariello | ..... | A63H 1/02 124/10 |
| 4,277,068 A * | 7/1981 | Sasaki | ..... | F41B 7/08 124/10 |
| 5,199,410 A * | 4/1993 | Cheng | ..... | A63H 27/14 124/10 |
| 7,673,624 B2 * | 3/2010 | Rosella, Jr. | ..... | A63F 9/02 124/10 |

* cited by examiner

*Primary Examiner* — John A Ricci

(57) ABSTRACT

The present invention is a toy projectile and launcher system. The lightweight projectile has an exterior surface symmetrically disposed about an imaginary longitudinal axis. The launcher has a holding cavity composed of three semi-flexible sides, two of which sides apply counter-acting forces to the surface of the projectile along the imaginary longitudinal axis. The launcher has a mechanism for applying a motive force perpendicular to the counter-acting force vectors and perpendicular to the projectile's imaginary longitudinal axis. When the motive force is applied to the projectile, the semi-flexible sides deform and return to pre-deformation positions, thereby launching the projectile into flight.

6 Claims, 12 Drawing Sheets

MAGNUS EFFECT CYLINDRICAL PROJECTILE AND LAUNCHER

CLAIM TO PRIORITY

This application claims under 35 U.S.C. § 120, the benefit of the application Ser. No. 15/595,457, filed May 15, 2017, titled "Magnus Effect Cylindrical Projectile and Launcher" which is hereby incorporated by reference in its entirety.

COPYRIGHT AND TRADEMARK NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever. Trademarks are the property of their respective owners.

BACKGROUND

An object in flight that spins around an axis that is not aligned with its direction of travel is subject to the Magnus effect.

As an object in motion spins, the part of the object that is spinning into the oncoming air creates a small area of high pressure. Conversely, the part of the object that is spinning away from the oncoming air creates an area of low pressure. The areas of low pressure and high pressure produce a vectored force that can cause an object in flight to alter its direction. This movement is known as the Magnus effect in fluid dynamics. The Magnus effect enables cylindrical or tubular projectiles, when given sufficient linear and rotational velocities, to achieve lift and to move in a generally looping fashion.

In the toy industry, the Magnus effect has been implemented to affect interesting projectile flight patterns. The problem with existing technologies is the complexity of use. For instance, mechanisms that require wrapping a projectile with an elastic cord or string require hand and eye coordination that is beyond the skillset of many children and adults. In addition, elastic cords or strings are not easily aligned in the center of such a projectile. As a consequence, the projectile can easily be launched off-balance, destroying the necessary aerodynamic conditions and ruining the desired looping effect.

BRIEF DESCRIPTION OF THE DRAWINGS

Certain illustrative embodiments illustrating organization and method of operation, together with objects and advantages may be best understood by reference detailed description that follows taken in conjunction with the accompanying drawings in which.

DETAILED DESCRIPTION

Figure 1:
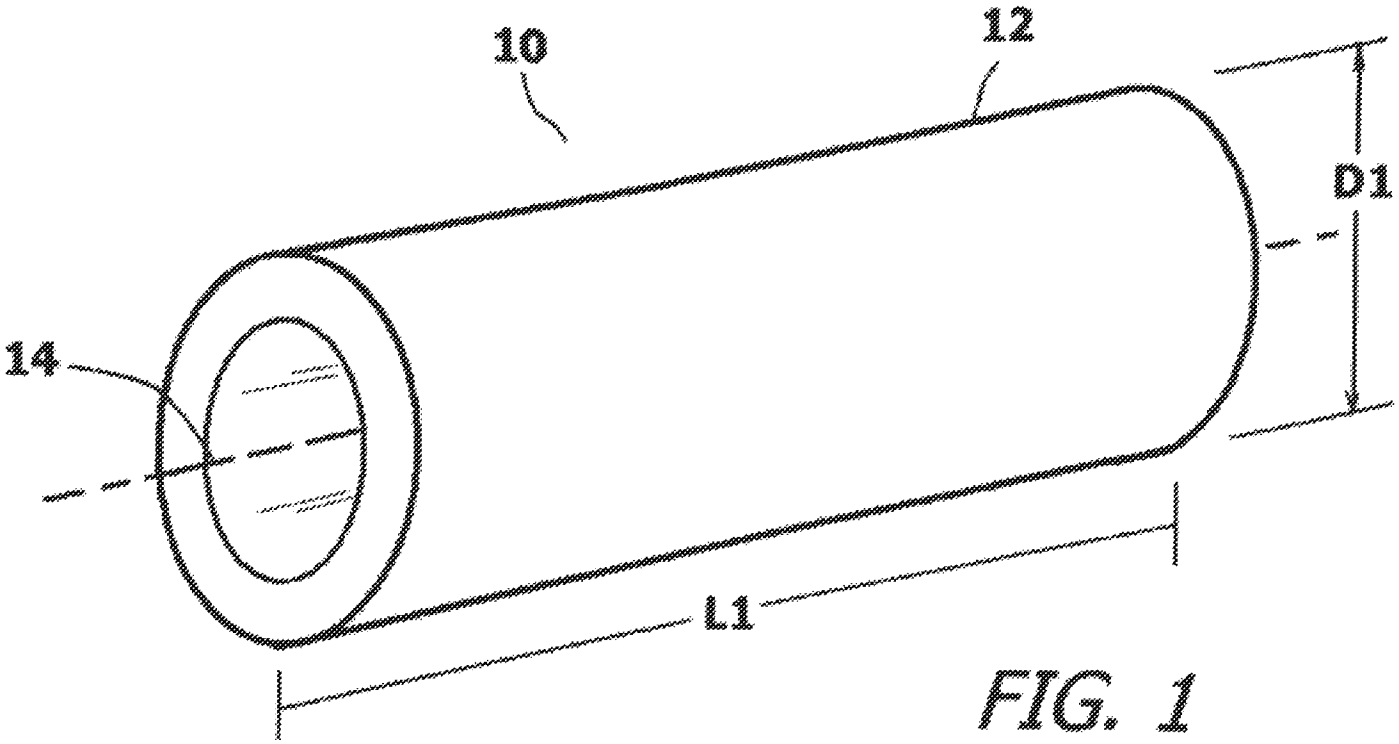
FIG. 1 is a perspective view of a projectile.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one, or more than one. The term "plurality", as used herein, is defined as two, or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an exemplary embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

Reference herein to "counter-acting forces" means opposing forces applied to the surface of a cylindrical projectile as said cylindrical projectile is held within a launcher holding cavity.

The present invention is a toy projectile and launcher system. The projectile is cylindrical in shape and lightweight. The projectile has an exterior surface that is symmetrically disposed about an imaginary longitudinal axis. In an embodiment, the launcher has a holding trough that receives and holds the tubular projectile. Within the launcher is a spring loaded element. The spring loaded element selectively moves between a cocked position and a released position. The spring loaded element is biased into its released position by a spring. When manually moved to its cocked position, the spring stores energy. The spring loaded element contacts the projectile in the holding trough as the spring loaded element moves from its cocked position to its released position. Contact with the spring loaded element causes the tubular projectile to launch into flight in a direction perpendicular to its longitudinal axis. Simultaneously, contact with the spring loaded element imparts a spinning rotation to the projectile, wherein the projectile spins about its longitudinal axis in flight. The spinning creates a Magnus effect on the projectile that helps keep it in flight and alters its flight path.

In an alternative embodiment, the innovation described herein is a tubular toy projectile and launcher system, with said projectile having an exterior surface that is symmetrically disposed about an imaginary longitudinal axis. The launcher includes planar leaves, which are rigid or semi-rigid plates of plastic, metal, carbon fiber, or some similar material, designed to hold said projectile between them, and designed variably to flex or remain rigid when struck by a force vector directed perpendicular to the face of the plate. The leaves are positioned opposite each other along said imaginary longitudinal axis, for receiving and holding projectile. The launcher includes a spring loaded element, supported by said launcher, that is selectively moved between a cocked position and a released position, wherein said spring loaded element contacts one or more of said planar leaves as said spring loaded element moves from said cocked position to said released position, and wherein contact between said spring loaded element and said one or more of said planar leaves causes said tubular projectile to launch into flight in a direction perpendicular to said longitudinal axis.

In an alternative embodiment, the innovation described herein is a tubular toy projectile and launcher system, where said projectile has an exterior surface that is symmetrically disposed about an imaginary longitudinal axis and said launcher has holding pins positioned opposite each other along said imaginary longitudinal axis, for receiving said tubular projectile. The launcher further includes a spring loaded element, supported by said launcher, that is selectively moved between a cocked position and a released position, wherein said spring loaded element contacts one or more of said holding pins as said spring loaded element moves from said cocked position to said released position, and wherein contact between said spring loaded element and said one or more of said holding pins causes said tubular projectile to launch into flight in a direction perpendicular to said longitudinal axis.

In an alternative embodiment, the innovation described herein is a cylindrical toy projectile and launcher system, where said projectile has an exterior surface that is symmetrically disposed about an imaginary longitudinal axis and said launcher has a holding cavity composed of at least three rigid sides, two of said rigid sides oriented in parallel and disposed to hold said projectile firmly between them. Said launcher includes a flexible ribbon immovably attached to said holding cavity at the distal end of the first of two rigid parallel sides and slidably attached at the distal end of the second of the two rigid parallel sides, such that said ribbon may translate the length of said holding cavity when acted upon by a force applied outside the holding cavity. The launcher further includes a spring loaded element or pneumatic piston element to provide a motive force. The said spring loaded element or pneumatic piston element is positioned outside the holding cavity and supported by said launcher, and is selectively moved between a cocked position and a released position. Said motive force acts upon said flexible ribbon as said spring loaded element or pneumatic piston element moves from said cocked position to said released position, and wherein contact between said spring loaded element or pneumatic piston element and said ribbon causes said cylindrical projectile to launch into flight in a direction perpendicular to said longitudinal axis.

In an alternate embodiment, the innovation described herein is a toy projectile and launcher system including a cylindrical projectile having an exterior surface that is symmetrically disposed about an imaginary longitudinal axis and a launcher having a holding cavity composed of three semi-rigid sides, two of said semi-rigid sides oriented and disposed to provide counter-acting forces along the imaginary longitudinal axis of said projectile. The launcher provides a motive force where said motive force acts upon said cylindrical projectile at a substantially right angle to said counter-acting forces and concomitantly upon said imaginary longitudinal axis to launch said cylindrical projectile into flight in a direction perpendicular to said imaginary longitudinal axis. By way of non-limiting example, this motive force may be provided by a spring loaded element, by a pneumatic piston element, or substantially by manual application. The launcher may include a highly tactile element for imparting rotational velocity to said projectile and a flexible ramp element, said flexible ramp element disposed to increase projectile's surface contact with said highly tactile element.

When applied substantially by manual application, the motive force may be effectuated by use of a ratchet mechanism which permits a user to incrementally advance the projectile away from the user toward the open end of the holding cavity. At the same time, such incremental advance increases the magnitude of the counter-acting forces acting upon the projectile. When the counter-acting forces are maximized, and the projectile is positioned at the open end of the holding cavity, the motive force may further position the projectile for rapid release of said counter-acting forces upon the projectile, thereby launching the projectile into flight. In such an embodiment, the cocking and trigger action of the launcher are simultaneous, minimizing pinch points and the danger to users thereby.

Although the present invention projectile and launcher can be embodied in many ways, only a few embodiments of the invention are illustrated and described. These embodiments are selected in order to set forth some of the best modes contemplated for the invention. The illustrated embodiments, however, are merely exemplary and should not be considered limitations when interpreting the scope of the appended claims.

Figure 2:
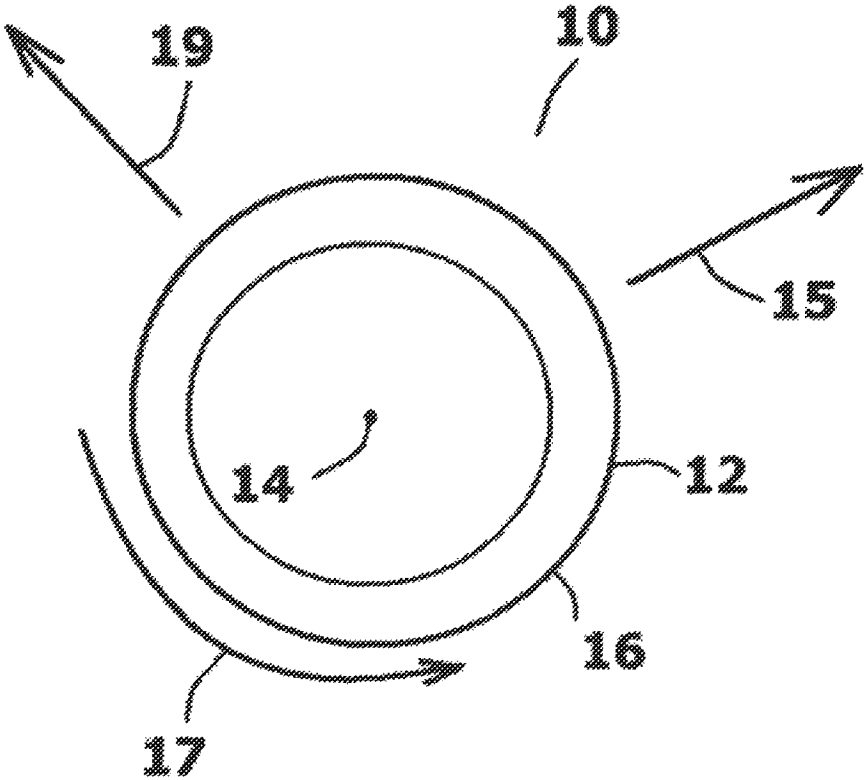
FIG. 2 is a side view of the projectile of FIG. 1 showing the forces that act upon the projectile in flight.

Referring to FIG. 1 and FIG. 2, a projectile 10 is shown. The projectile 10 has a cylindrical body 12 with a length L1 and a diameter D1 The cylindrical body 12 is mostly hollow in order to minimize weight. The length L1 is preferably at least three times as long as the diameter D1 is wide. The cylindrical body 12 is symmetrical formed about an imaginary long axis 14 that runs along its length L1 through the center of the projectile 10. The cylindrical body 12 can be fabricated from plastic or a laminated paper.

In FIG. 2, the projectile 10 is shown in flight, wherein it is traveling in the primary direction of arrow 15. As the projectile 10 is traveling in the direction of arrow 15, it is also spinning about its long axis 14 in the direction of arrow 17. The spinning of the projectile 10 moves some of the air near the exterior surface 16 of the projectile 10. This air moved by the projectile 10 creates a slight high pressure under the projectile 10 and a slight low pressure above the projectile 10. The high pressure and low pressure act upon the projectile 10 and create a vectored Magnus force in the direction of arrow 19. The Magnus force is generally perpendicular to the forward direction of flight. The Magnus force therefore initially creates an upward force that inclines the direction of flight. As the Magnus force continues, it tends to cause the projectile 10 to fly vertically in a circle, therein producing a loop in flight. As such, the Magnus force tends to cause the projectile 10 to loop and return to its point of origin.

Figure 3:
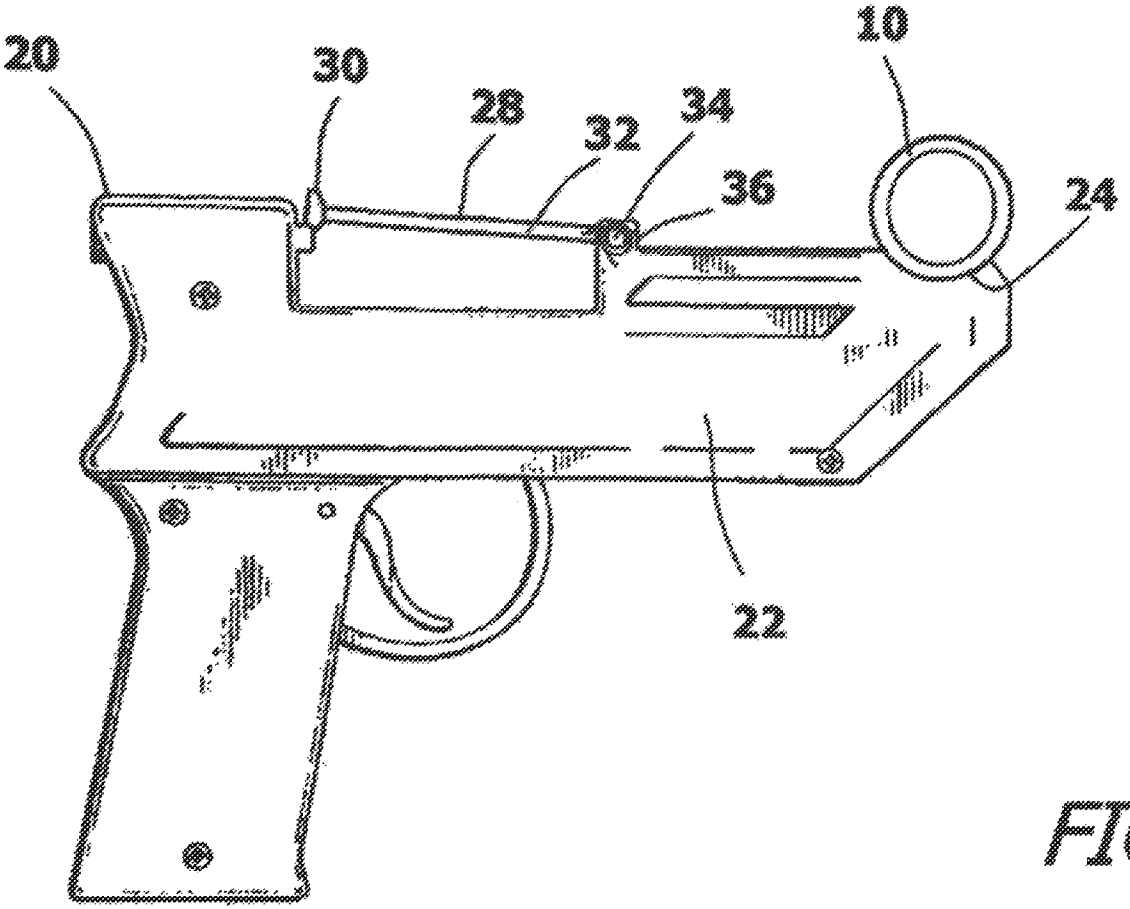
FIG. 3 is a side view of a launcher and projectile in a cocked and ready position.
Figure 4:
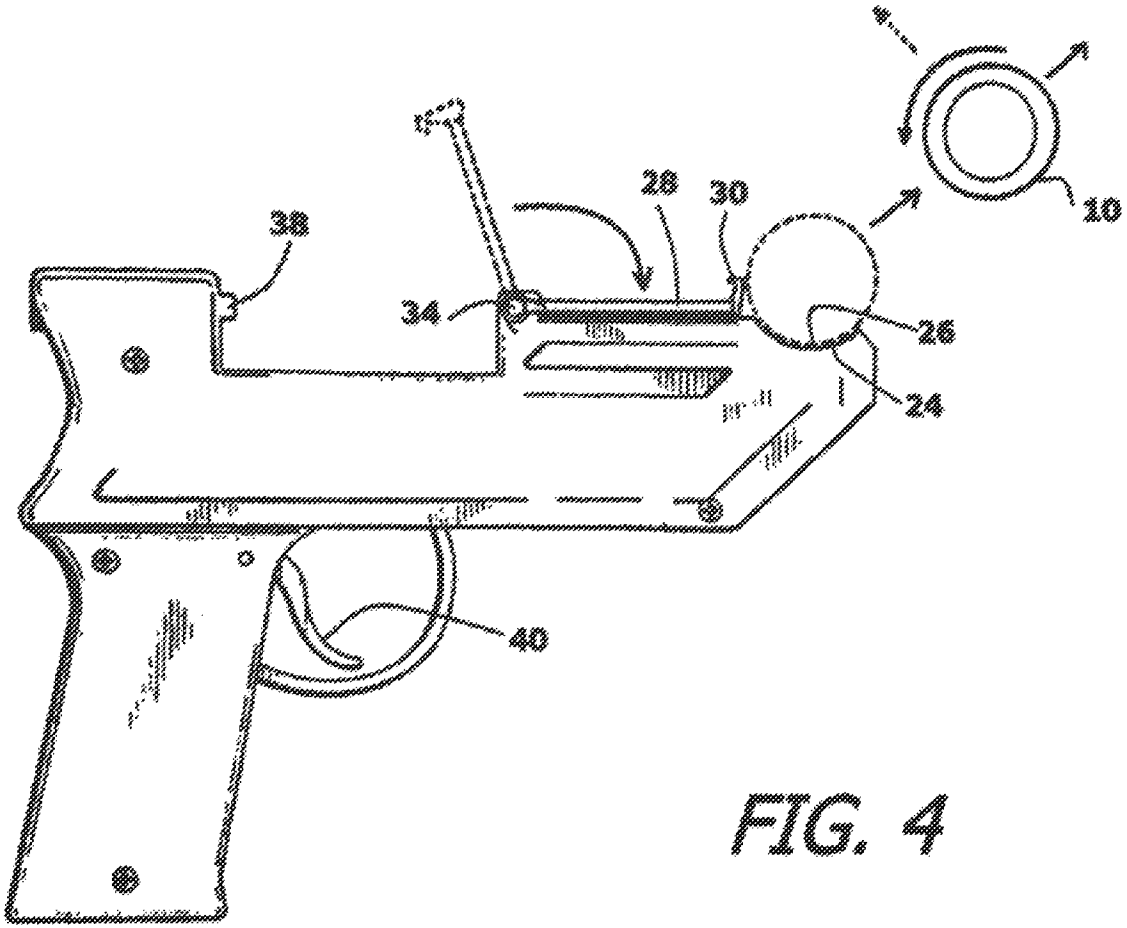
FIG. 4 shows the launcher and projectile of FIG. 3 in a released position.

Referring to FIG. 3 and FIG. 4 in conjunction with earlier figures, a first embodiment of a launcher 20 is shown. In this embodiment, the launcher 20 contains a base 22. A holding trough 24 is formed in the base 22. The holding trough 24 has an interior surface 26 that is very smooth and has a low coefficient of friction. The holding trough 24 has a radius of curvature that matches the exterior surface 16 of the projectile 10. A spring loaded hammer 28 is provided. The hammer 28 has a head 30 that strikes the projectile 10 at a tangent. The head 30 of the hammer 28 is preferably covered in an elastomeric material that has a high degree of resiliency and a high coefficient of friction. The head 30 of the hammer 28 contacts the projectile 10 along a tangent while traveling at a high speed. This has two effects. First, it provides the projectile 10 with a large amount of rotational energy. This causes the projectile 10 to spin. Second, the head 30 of the hammer 28 transfers kinetic energy to the projectile 10 and knocks the projectile 10 out of the holding trough 24 and into flight.

The hammer 28 contains one or two arms 32 that support the head 30. The arms 32 are pivotally connected to the base 22 at pivot connections 34. The arms 32 are biased into a released position that holds the head 30 immediately adjacent the holding trough 24. The spring bias is provided by one or two torsion springs 36 that connect to both the base 22 and the arms 32. The hammer 28 can be manually moved into a cocked position against the bias of the springs 36. To do this, the hammer 28 is rotated about the pivot connections 34 until the head 30 of the hammer 28 connects to a trigger catch 38. The trigger catch 38 is opened by the pulling of a trigger lever 40 under the base 22.

Once the hammer 28 is rotated to its cocked position, spring energy is stored in the springs 36. When the trigger lever 40 is pulled, the trigger catch 38 disengages the head 30. The stored spring energy then causes the hammer 28 to rotate in the manner of a mousetrap. The head 30 on the hammer 28 accelerates with the rotating hammer 28 until the head 30 strikes the side of the projectile 10. The head 30 of the hammer 28 strikes the projectile 10 with a glancing blow that acts at a tangent to the curvature of the projectile 10. This transfers much of the energy from the hammer 28 to the projectile 10 in the form of spin. However, the contact with the hammer 28 also has the effect of displacing the projectile 10 from the holding trough 24 and launching the projectile 10 into flight. The projectile 10 rotates rapidly around its long axis 14 as it is launched into flight. The forward projection away from the holding trough 24 and the rapid rotation create a Magnus force that helps to keep the projectile 10 in flight. As previously mentioned, the projectile 10 tends to fly up and around in a looping flight path.

Figure 5:
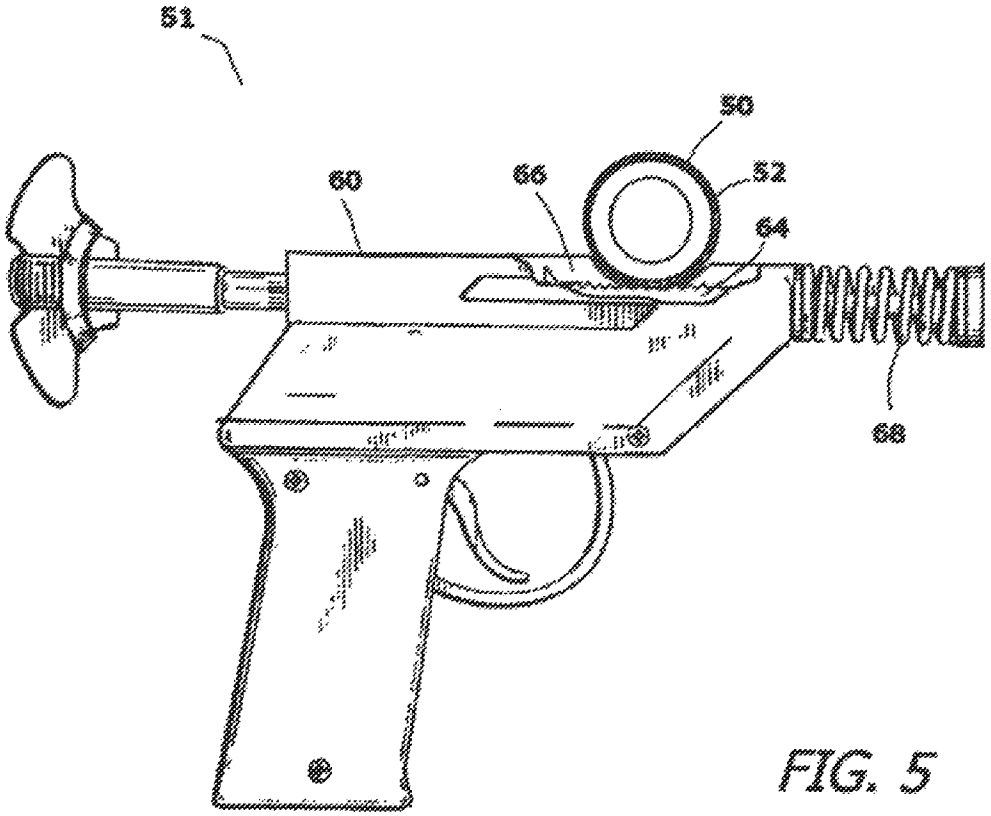
FIG. 5 shows an alternate embodiment of a launcher and projectile in a cocked and ready position.
Figure 6:
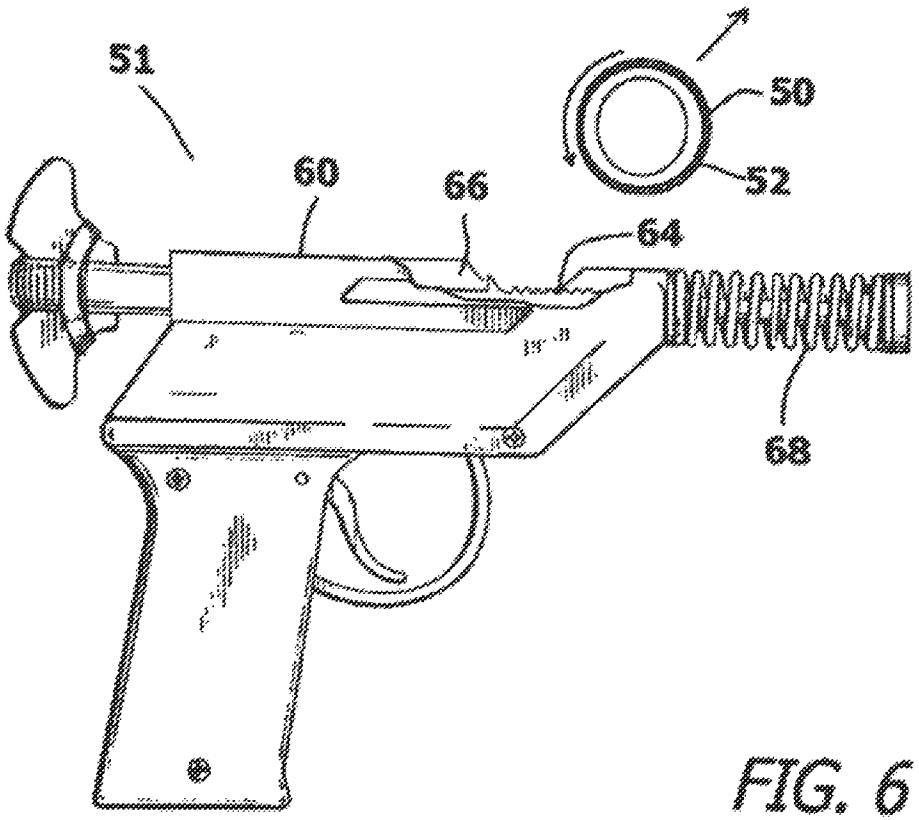
FIG. 6 shows the launcher and projectile of FIG. 5 in a released position.

Referring to FIG. 5 in conjunction with FIG. 6, an alternate embodiment of a projectile 50 and launcher 60 are described. In this embodiment, the projectile 50 is provided with a narrow ring of gear teeth impressions 52 at its midpoint along its long axis 54. The launcher 60 has a holding trough 62 for holding the projectile 50. A gear rack 64 is provided. The gear rack 64 is disposed in a track 66 that passes through the holding trough 62. The gear rack 64 is spring loaded with a spring 68. A pull tab 70 is present at one end of the gear rack 64. When the pull tab 70 is pulled, the gear rack 64 moves horizontally in the track 66 and the spring 68 compresses. Once the spring 68 is fully compressed, the gear rack 64 engages an internal trigger catch that holds the gear rack 64 and spring 68 in a cocked position. The trigger catch 72 is operated by a trigger lever 74. When the trigger lever 74 is pulled, the gear rack 64 is released. The spring 68 releases its stored energy and the gear rack 64 is rapidly accelerated horizontally in the track 66 from a cocked position to a released position.

The projectile 50 is placed in the holding trough 62 so that the gear teeth impressions 52 on the projectile 50 intermesh with the gear rack 64. When the gear rack 64 is released from its cocked position, the gear rack 64 rapidly moves under the projectile 50. This causes the projectile 50 to spin rapidly. As the gear rack 64 moves, the pull tab 70 eventually contacts the projectile 50. The pull tab 70 has an inclined surface 76 that strikes the projectile 50 and launches it into flight while it is spinning. The forward projection away from the holding trough 62 and the rapid rotation creates a Magnus force that helps to keep the projectile 50 in flight. As previously mentioned, the projectile 50 tends to fly up and around in a looping flight path.

Figure 7:
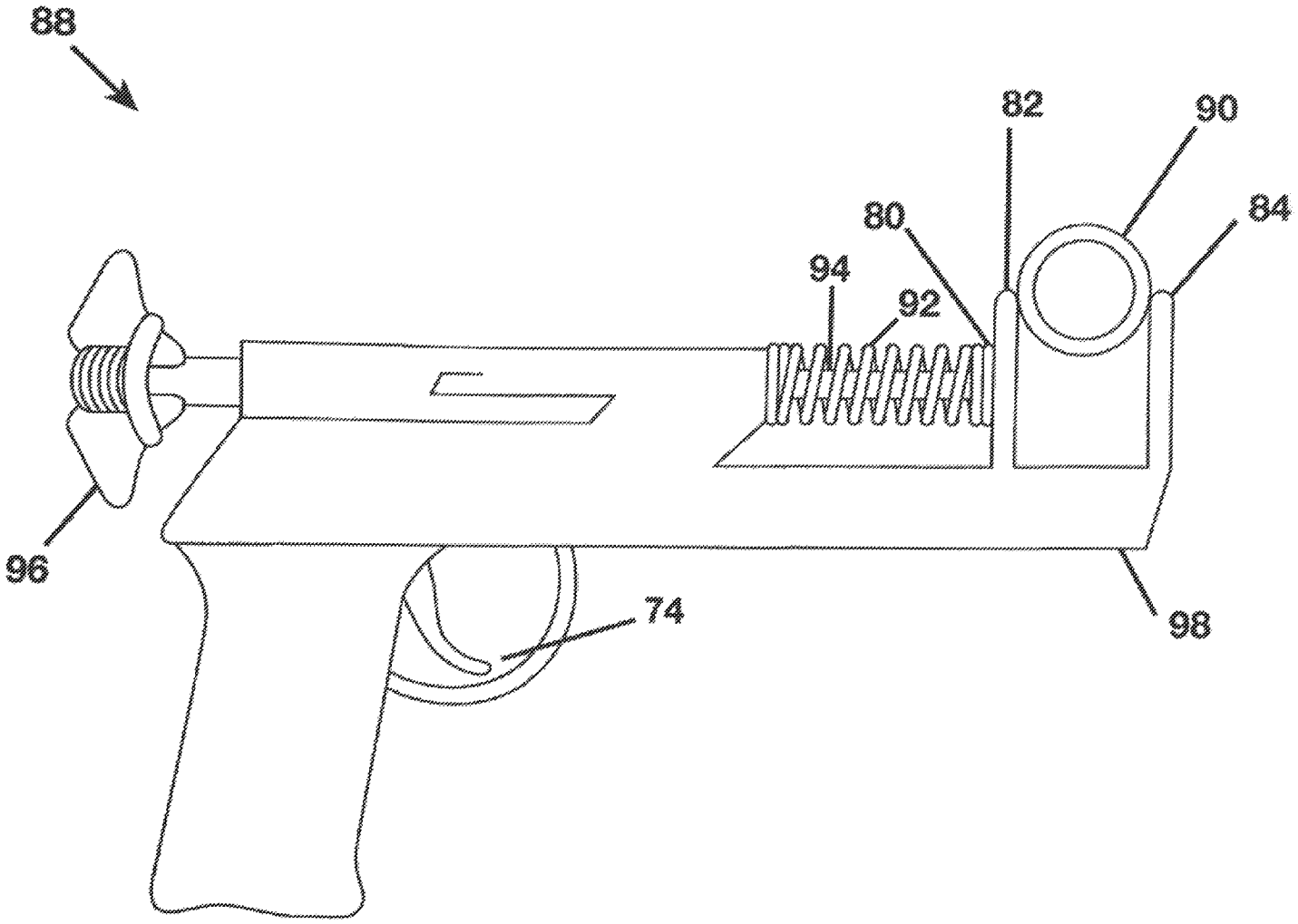
FIG. 7 is a side view of a launcher and projectile consistent with certain embodiments of the present invention.

Referring to FIG. 7, the launcher 88 has a first planar leaf 82 and a second planar leaf 84 for holding projectile 90, said first planar leaf 82 and second planar leaf 84 held opposite each other by extrusion 98. In an embodiment, planar leaves, the plural of "planar leaf," are rigid or semi-rigid plates of plastic, metal, carbon fiber, or some similar material, designed to hold projectile 90 between them, and designed variably to flex or remain rigid when struck by a force vector directed perpendicular to the face of the plate. A plunger 94 is provided. The plunger 94 is spring-loaded with spring 92. A handle 96 is present at one end of the plunger 94. When the handle 96 is pulled, the plunger 94 moves horizontally within an internal track, and the spring 92 compresses. Once the spring 92 is fully compressed, the plunger 94 engages an internal trigger catch that holds the plunger 94 and the spring 92 in a cocked position. An internal trigger catch is operated by trigger lever 74. When the trigger lever 74 is pulled, the plunger 94 is released. The spring 92 releases its stored energy and the plunger 94 is rapidly accelerated horizontally in an internal track, from a cocked position to a released position.

The projectile 90 is placed between the distal ends of planar leaf 82 and planar leaf 84 such that an imaginary line drawn between the ends of planar leaf 82 and planar leaf 84 bisects the cross-section of projectile 90. When the plunger 94 is released from its cocked position, plunger head 80 moves rapidly toward and strikes planar leaf 82. Projectile 90 is pinched between planar leaf 82 and planar leaf 84, launching projectile 90 into flight while spinning. The forward projection away from the planar leaf 82 and the rapid rotation creates a Magnus force that helps to keep the projectile 90 in flight. The projectile 90 tends to fly up and around in a looping flight path.

Figure 8:
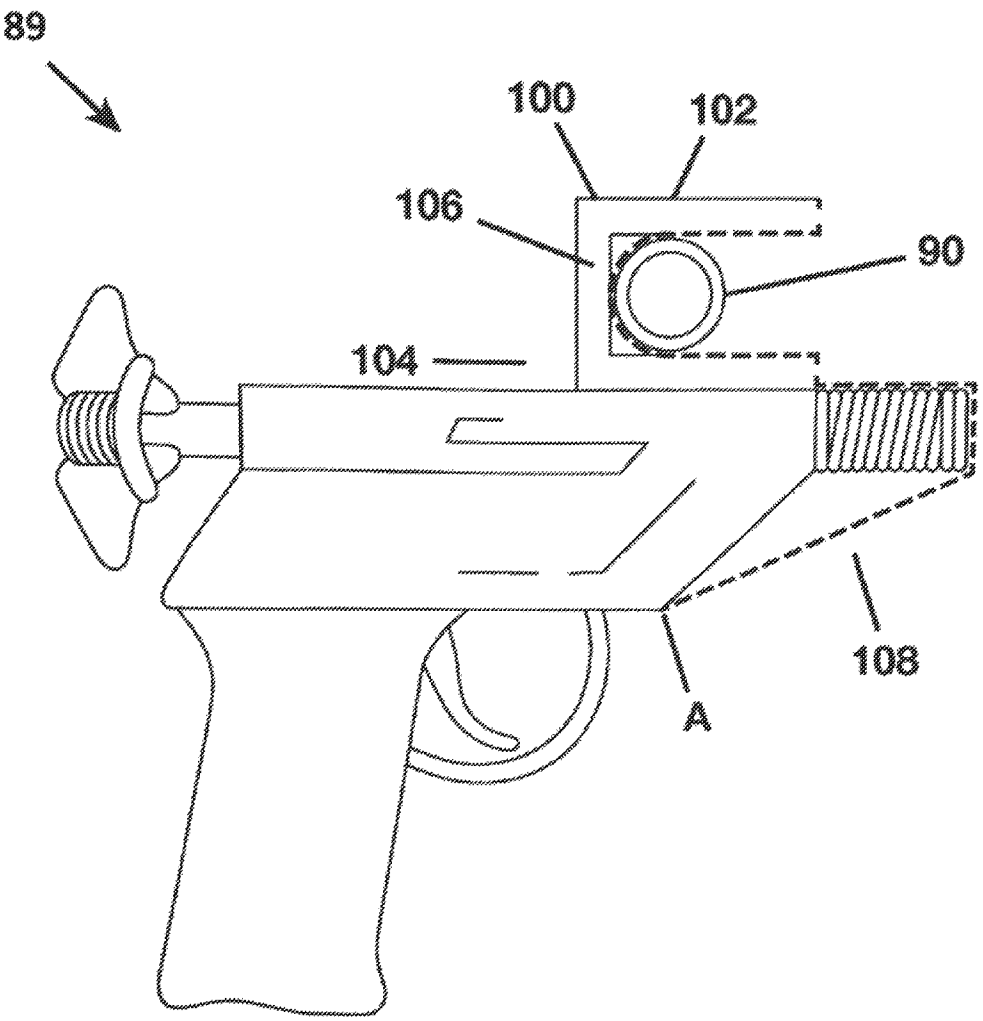
FIG. 8 is a side view of an alternate embodiment of a launcher and projectile consistent with certain embodiments of the present invention, showing the launcher in a cocked and ready position.
Figure 9:
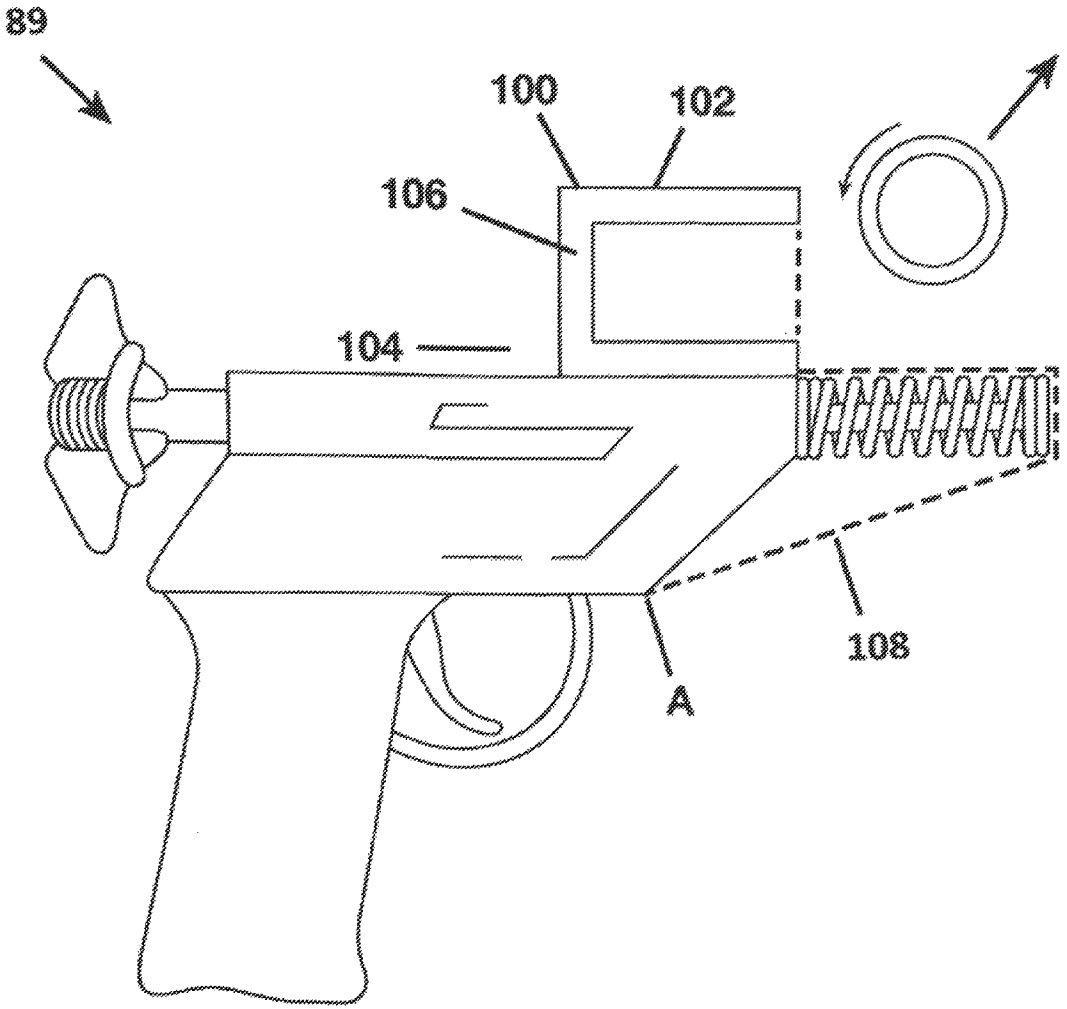
FIG. 9 is a side view of the launcher and projectile of FIG. 8 consistent with certain embodiments of the present invention, showing the launcher and projectile of FIG. 8 in a released position.

Referring to FIG. 8 in conjunction with FIG. 9, launcher 89 is surmounted by a roughly C-shaped compartment 100. C-shaped compartment 100 is defined by a first linear member 102 and a parallel second linear member 104 connected at one end by a short connector member 106. In an embodiment, linear members are rigid plates of plastic, metal, carbon fiber, or some similar material, designed to hold projectile 90 between them, and designed to remain rigid when acted upon by a force vector directed perpendicular to the face of the plate. In an embodiment, the C-shaped compartment 100 is oriented such that the second linear member 104 lies horizontally on top of launcher 89, and the short connector member 106 is directed toward the rear of the launcher 89. A low-friction ribbon 108 is provided. A first distal end of ribbon 108 is attached to first linear member 102. Ribbon 108 then runs along the inside of first linear member 102, around the rear-facing side of projectile 90, along the inside of second rigid linear member 104, and is connected to the launcher at point A.

A plunger is provided. The plunger is spring-loaded with spring. A handle is present at one end of the plunger. When handle is pulled, plunger moves horizontally within an internal track, and spring compresses. Once the spring is fully compressed, the plunger engages an internal trigger catch that holds the plunger and the spring in a cocked position. An internal trigger catch is operated by trigger lever. When the trigger lever is pulled, the plunger is released. The spring releases its stored energy and the plunger is rapidly accelerated horizontally in an internal track, from a cocked position to a released position.

The projectile 90 is placed between the first linear member 102 and second linear member 104, with the ribbon 108 running along the inside of first rigid linear member 102, around the rear-facing side of projectile 90, and along the inside of second rigid linear member 104. In an embodiment, the distance between first linear member 102 and second linear member 104 is only slightly greater than the diameter of projectile 90, and with the addition of ribbon 108, first linear member 102 and second linear member 104 hold projectile 90 firmly between them. When the plunger is released from its cocked position, plunger head moves rapidly toward and strikes ribbon 108, pushing the bottom-most section of ribbon 108 out from the C-shaped compartment 100. Because projectile 90 is held tightly between first linear member 102 and second linear member 104, ribbon 108 imparts a rotational velocity to projectile 90 as ribbon 108 is drawn out from the C-shaped compartment 100. Simultaneously, ribbon 108 imparts a linear velocity to projectile 90. When plunger is fully extended, ribbon 108 is pulled taut, and projectile 90 is launched into flight while spinning. The forward projection away from the C-shaped compartment 100 and the rapid rotation creates a Magnus force that helps to keep the projectile 90 in flight. The projectile 90 tends to fly up and around in a looping flight path.

Figure 10:
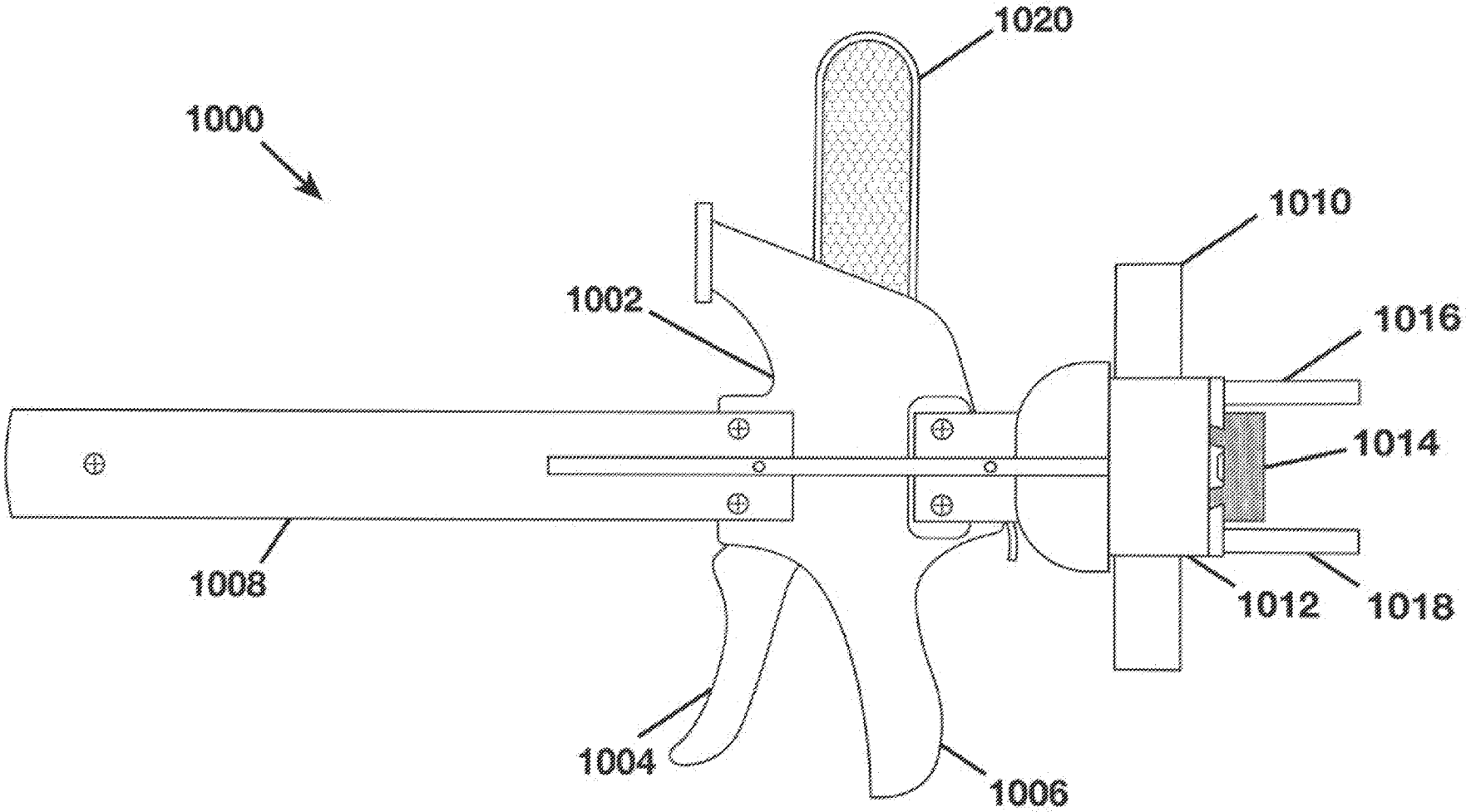
FIG. 10 is a top view of an alternate embodiment of a launcher and projectile consistent with certain embodiments of the present invention.

Referring to FIG. 10, a top view of an alternate embodiment of a launcher and projectile consistent with certain embodiments of the present invention is shown. Launcher 1000 is composed of a hollow barrel 1008 that contains a tension spring (not shown), a left handle 1002, a right handle 1006, a trigger 1004, a handle extension 1020, a roughly C-shaped metal clamp 1012, a highly tactile launch plate 1014, a left flexible launch ramp 1016 and a right flexible launch ramp 1018. Projectile 1010 is inserted into the open portion of the metal clamp 1012 from the left side or the right side of the metal clamp 1012. The projectile 1010 remains so positioned until a user of launcher 1000 commences launch by holding left handle 1002 in his or her left hand and squeezing trigger 1004 toward right handle 1006 with his or her right hand.

Figure 11:
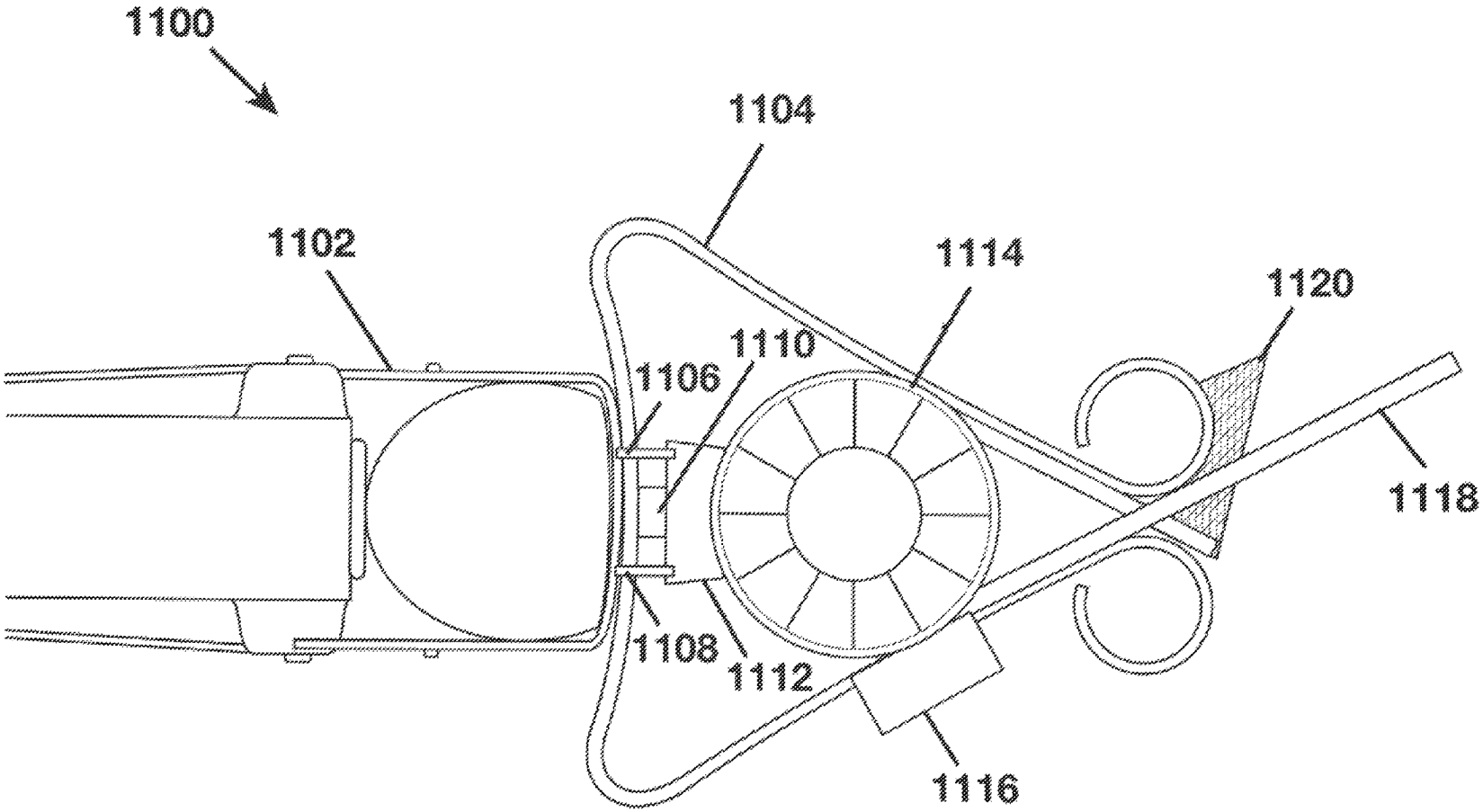
FIG. 11 is a side view of the user-distant end of the launcher of FIG. 10 showing the portion operative to launch the projectile in a relaxed state.

Turning to FIG. 11, a side view of the user-distant end 1100 of the launcher of FIG. 10 showing the portion operative to launch the projectile in a relaxed state is shown. Referring to FIG. 11 in conjunction with FIG. 10, when user squeezes trigger 1004 toward right handle 1006, plunger 1110 extends out of barrel 1102 and toward projectile 1114. Rigid clips 1106 and 1108 hold the proximal side of C-shaped metal clamp 1104 to barrel 1102 such that the proximal end of C-shaped metal clamp 1104 may flex and move under force provided by plunger 1110 in concert with projectile 1114. Rigid clips 1106 and 1108 have matching, complementary clips (not shown) on the distal side of C-shaped metal clamp 1104. The matching, complementary clips perform the same function on the distal end of C-shaped metal clamp 1104 as the rigid clips 1106 and 1108 perform on the proximal end.

Plunger 1110 is capped with plate 1112 that applies force from plunger 1110 evenly along the center portion of the linear axis of projectile 1114. Tensioner 1116 applies force perpendicular to the direction of travel of projectile 1114 such that projectile 1114 remains contained inside C-shaped metal clamp 1104 when the user-distant end 1100 is at rest.

Figure 12:
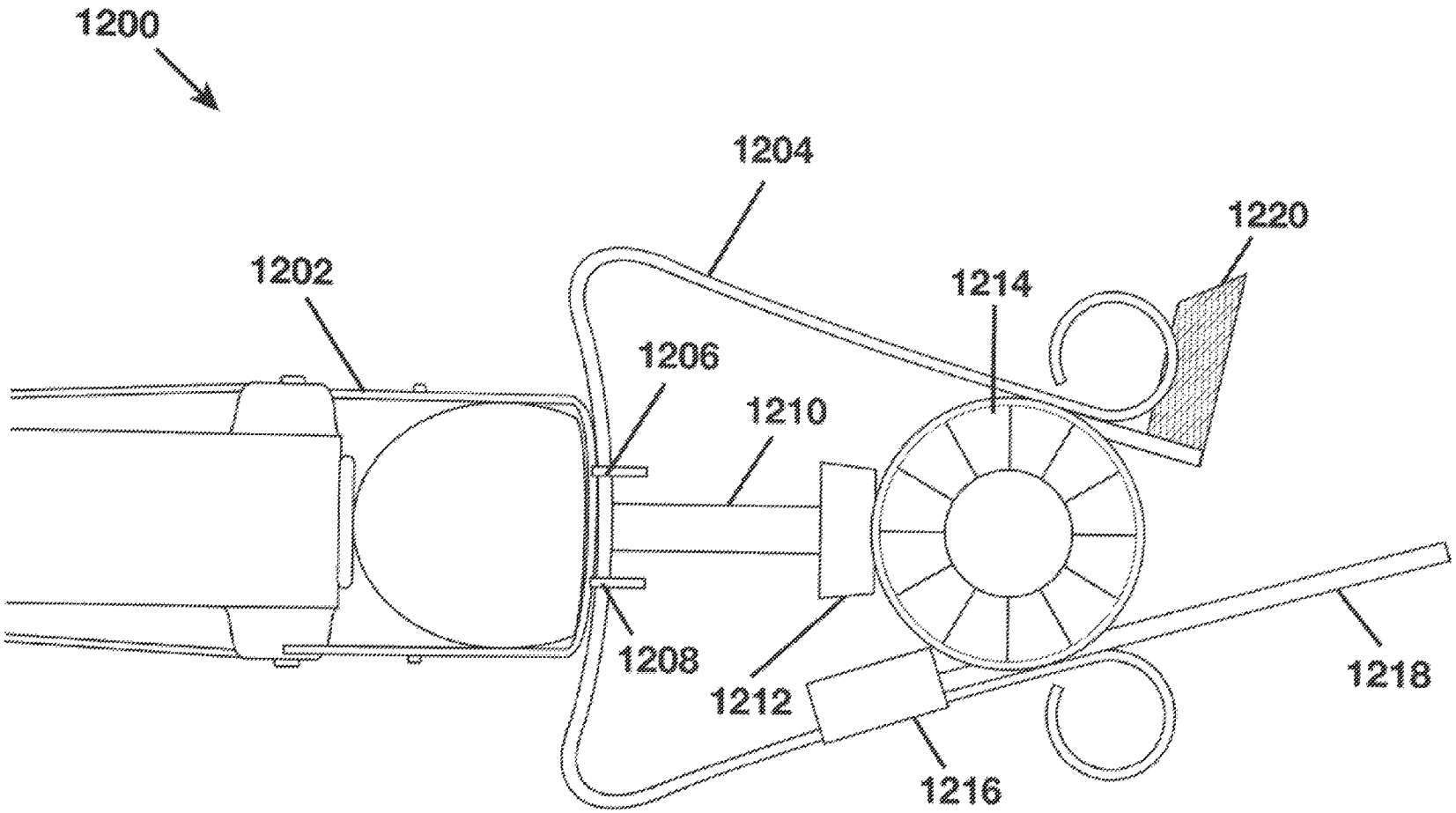
FIG. 12 is a side view of the user-distant end of the launcher of FIG. 10 showing the portion operative to launch the projectile in a pre-launch tensioned state.

Turning to FIG. 12, a side view of the user-distant end 1200 of the launcher of FIG. 10 showing the portion operative to launch the projectile in a pre-launch tensioned state is shown. Plunger 1210 and plate 1212 have been advanced by user toward the projectile 1214. As projectile 1214 has moved in the direction of the force applied by plunger 1210 and plate 1212, projectile 1214 has in turn applied force to the top and bottom portions of the C-shaped metal clamp 1204, deforming the C-shaped metal clamp 1204. Having advanced past the range of tensioner 1216, projectile 1214 is now held firmly between the plate 1212 and encompassing portions of C-shaped metal clamp 1204. Tensioner 1216 has returned to its relaxed state.

As user continues to so advance plunger 1210 and plate 1212, projectile 1214 continues to advance in tandem. As projectile 1214 moves just past the upper portion of C-shaped metal clamp 1204, C-shaped metal clamp 1204 returns to a relaxed, pre-deformation state, pinching the user-proximate side of projectile 1214 between highly tactile launch plate 1220 and left flexible launch ramp (not shown) and right flexible launch ramp 1218. Highly tactile launch plate 1220 imparts counter-clockwise rotational velocity to projectile 1214. Left flexible launch ramp and right flexible launch ramp 1218 impart vertical velocity to projectile 1214. This combination of velocities imparts to the projectile 1214 a generally looping flight path. User can reset plunger by employing tension spring in hollow barrel.

While certain illustrative embodiments have been described, it is evident that many alternatives, modifications, permutations and variations will become apparent to those skilled in the art in light of the foregoing description.

I claim:

1. A toy projectile and launcher system, comprising:

a cylindrical projectile having an exterior surface that is symmetrically disposed about an imaginary longitudinal axis;

a launcher having a holding cavity composed of three semi-rigid sides, two of said semi-rigid sides oriented and disposed to provide counter-acting forces along the imaginary longitudinal axis of said projectile;

a motive force where said motive force acts upon said cylindrical projectile at a substantially right angle to said counter-acting forces and concomitantly upon said imaginary longitudinal axis;

said motive force and said counter-acting forces enabling lift in said cylindrical projectile in a direction perpendicular to said imaginary longitudinal axis.

2. The system according to claim 1, where said motive force is provided by a spring loaded element.

3. The system according to claim 1, where said motive force is provided by a pneumatic piston element.

4. The system according to claim 1, where said motive force is provided substantially by manual application.

5. The system according to claim 1, further comprising a highly tactile element for imparting rotational velocity to said projectile.

6. The system according to claim 5, further comprising a flexible ramp element, said flexible ramp element disposed to increase projectile's surface contact with said highly tactile element.

* * * * *